US009869495B2

(12) United States Patent
Gill

(10) Patent No.: US 9,869,495 B2
(45) Date of Patent: Jan. 16, 2018

(54) MULTI-CYCLE POWER GENERATOR

(71) Applicant: Martin Gordon Gill, Johannesburg (ZA)

(72) Inventor: Martin Gordon Gill, Johannesburg (ZA)

( * ) Notice: Subject to any disclaimer, the term of this patent is extended or adjusted under 35 U.S.C. 154(b) by 96 days.

(21) Appl. No.: 14/907,619

(22) PCT Filed: Aug. 1, 2014

(86) PCT No.: PCT/ZA2014/000035

§ 371 (c)(1),
(2) Date: Jan. 26, 2016

(87) PCT Pub. No.: WO2015/017873

PCT Pub. Date: Feb. 5, 2015

(65) Prior Publication Data

US 2016/0161158 A1 Jun. 9, 2016

(30) Foreign Application Priority Data

Aug. 2, 2013 (ZA) ..... 13/5913

(51) Int. Cl.
*F25B 30/02* (2006.01)
*F25B 11/02* (2006.01)
*F25B 23/00* (2006.01)

(52) U.S. Cl.
CPC ..... *F25B 30/02* (2013.01); *F25B 11/02* (2013.01); *F25B 23/006* (2013.01)

(58) Field of Classification Search
CPC ..... F25B 30/02; F25B 11/02; F25B 23/006
USPC ..... 60/655; 62/6
See application file for complete search history.

(56) References Cited

U.S. PATENT DOCUMENTS 3,789,804 A 2/1974 Aguet
3,965,675 A 6/1976 Martz et al.
4,428,190 A 1/1984 Bronicki
4,531,374 A 7/1985 Alefeld
(Continued)

FOREIGN PATENT DOCUMENTS

WO 2008115236 A1 9/2008

OTHER PUBLICATIONS

Tas Energy, "The Power of the Sun", www.tas.com/renewable-energy/solar-thermal/overview.html, last accessed Jul. 26, 2014.
(Continued)

*Primary Examiner* — Hoang Nguyen
(74) *Attorney, Agent, or Firm* — Haugen Law Firm PLLP

(57) ABSTRACT

This invention relates to a multi-cycle power generator. More specifically, the invention relates to a power generator having a heat pump cycle and at least a hot power generating cycle, the cycles being configured relative to one another to transfer heat there between two or more times in a single cycle thereby to recover energy through the reuse of unused heat energy that is typically discarded in conventional ther-modynamic cycles. The multi-cycle power generator includes a heat pump cycle and a hot power cycle, wherein at least a pair of heat exchangers of the hot power cycle are common with a pair of heat exchangers of the heat pump cycle. The multi-cycle power generator may further include a cool power generating cycle In combination with the heat pump and hot power generating cycles.

16 Claims, 1 Drawing Sheet

(56) References Cited

U.S. PATENT DOCUMENTS

| | | | | |
|---|---|---|---|---|
| 4,831,817 | A | 5/1989 | Linhardt | |
| 5,136,854 | A | 8/1992 | Abdelmalek | |
| 6,035,643 | A | 3/2000 | Rosenblatt | |
| 6,913,076 | B1 * | 7/2005 | Hays | F25B 11/02 165/274 |
| 8,707,701 | B2 * | 4/2014 | Burkhart | F01K 27/00 60/641.2 |
| 2004/0088993 | A1 | 5/2004 | Radcliff et al. | |
| 2004/0107700 | A1 | 6/2004 | McClanahan et al. | |
| 2005/0022499 | A1 | 2/2005 | Belokon et al. | |
| 2006/0048515 | A1 | 3/2006 | Limron et al. | |
| 2006/0053820 | A1 | 3/2006 | Taras et al. | |
| 2006/0196187 | A1 | 9/2006 | Limron et al. | |
| 2007/0095066 | A1 | 5/2007 | Kaplan | |
| 2008/0006040 | A1 * | 1/2008 | Peterson | B60H 1/3204 62/116 |
| 2008/0041057 | A1 * | 2/2008 | Thomas | F01D 15/00 60/683 |
| 2008/0168772 | A1 | 7/2008 | Radcliff et al. | |
| 2009/0121495 | A1 | 5/2009 | Mills | |
| 2009/0211253 | A1 | 8/2009 | Radcliff et al. | |
| 2009/0241546 | A1 | 10/2009 | Hegazy | |
| 2009/0277173 | A1 | 11/2009 | Ernst et al. | |
| 2011/0209474 | A1 | 9/2011 | Liebowitz | |
| 2011/0308250 | A1 | 12/2011 | Mahl | |
| 2013/0074499 | A1 | 3/2013 | Palmer | |

OTHER PUBLICATIONS

Chegg.com, "Combined Gas-Steam Power Cycle", http://www.chegg.com!homework-help/questions-and-answers/consider-combined-gas-steam-power-cycle-topping-cycle-simple-brayton-cycle-following-lm . . . last accessed Jul. 23, 2014.

International Written Opinion and Search Report issued in priority application No. PCT/ZA2014/000035 dated Apr. 27, 2015.

* cited by examiner

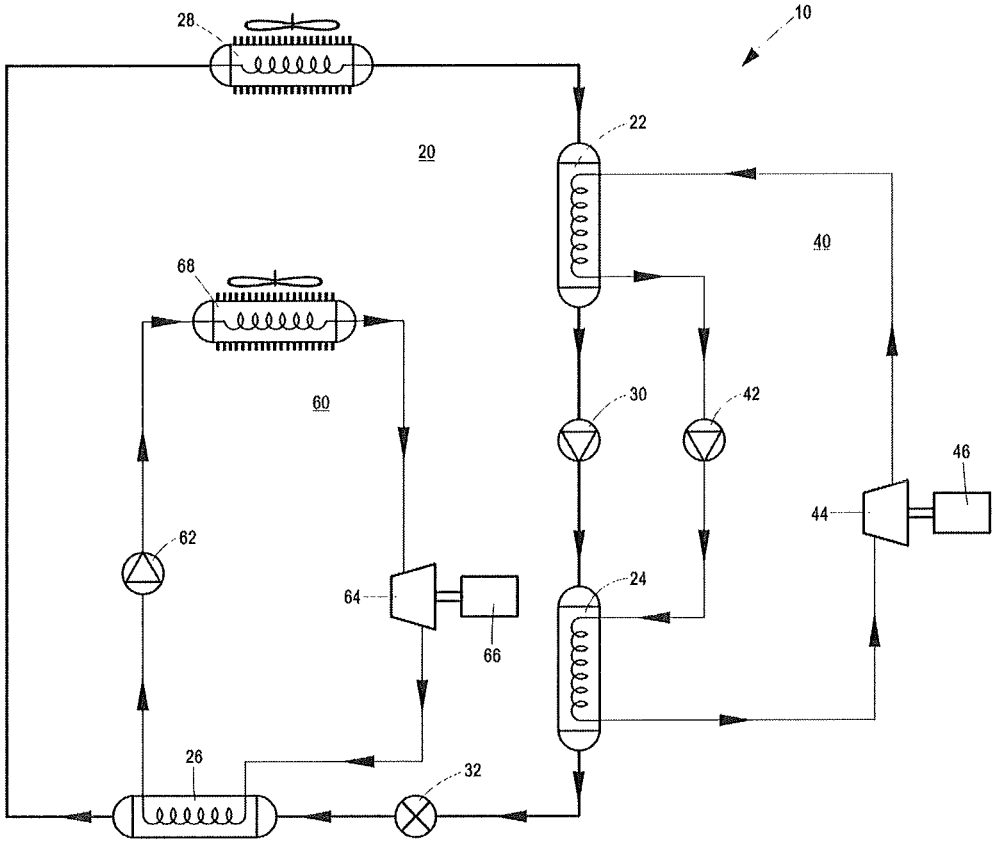
10
28
22
20
40
68
60
30
42
46
44
62
64
24
66
26
32

MULTI-CYCLE POWER GENERATOR

BACKGROUND OF THE INVENTION

This invention relates to a multi-cycle power generator. More specifically, the invention relates to a power generator having a heat pump cycle and at least a hot power generating cycle, the cycles being configured relative to one another to transfer heat there between two or more times in a single cycle thereby to recover energy through the reuse of unused heat energy that is typically discarded in conventional thermodynamic cycles. The invention may further include a cool power generating cycle in combination with the heat pump and hot power generating cycles.

Systems incorporating energy recovery for the purposes of maximising efficiency are well known, particularly in the air conditioning industry where systems to heat and/or cool building interiors generally consume large amounts of power.

Energy recovery in these systems can take many forms. For example, patent document U.S. Pat. No. 5,136,854 discloses a refrigeration cycle with a compressor thereof shaft mounted to a turbine of a secondary hot power cycle. The turbine is powered by the secondary hot power cycle, and in turn transmits power to the compressor of the refrigeration cycle through the shaft. In this manner, the power normally required to drive the compressor is reduced, thereby making the system more efficient.

Another example is the invention described in international patent application no. PCT/US2007/064506 (published as WO 2008/115236). This patent document discloses the principle of energy recovery by combining a power cycle with a heat pump cycle, the latter of which already being regarded as a very efficient means of pumping heat (typical coefficient of performance of between 3 and 8). In this system, heat is transferred from the heat pump cycle to the power cycle via a common heat exchanger.

Yet another example is a solar thermal energy system developed by Tas Energy (www.tas.com), which combines a steam Rankin cycle with an organic Rankin cycle through a common heat exchanger. In this manner, the heat that would typically be discarded from the Rankin cycle is transferred to the organic Rankin cycle, having a working fluid with a boiling point lower than the working fluid of the Rankin cycle.

Although the energy recovery methods made use of in the aforementioned prior art systems already work to better the efficiency of such systems, they do not make use of multiple (i.e. at least double) heat transfer between cycles, which allows heat to be recycled through the heat pump to increase energy recovery efficiency. It is envisaged that by further combining hot and cool power cycles with a heat pump cycle, the further increase in efficiency will be significant as compared to known systems.

It is common knowledge that that energy cannot be created or destroyed, only converted—for example, converting heat energy into kinetic energy. It is also common knowledge that a heat pump is capable of not only moving heat from one location to another, but also capable of itself transferring heat energy to the working fluid by the work it performs thereon.

Heat pumps typically have a coefficient of performance (COP) of above 1 in respect of moving heat. However, the COP of heat pumps is respect of heating the working fluid is generally less than 1, which is not as good as a heating element. As such, heat pumps are very efficient at moving heat, but not as efficient at heating.

What follows is an explanation of the advantages of using a heat pump, in accordance with the present invention, which typically has a COP of 3 to 8 when it comes to heating objects. This means that 1 unit of energy is required to move 3 to 8 units of energy up a gradient. The efficiency of the system is determined by many factors including the size of the gradient of energy transfer, meaning that heat can be extracted out of the atmosphere or other heat sources, and "concentrated" to a useful level for, amongst other things, boiling fluids.

The steam pressure generated, and/or temperature thereof, can then be used to generate electricity, which can consequently be used to at least partially drive the heat pump, used to power other devices and/or be stored. The energy utilization of the steam is not always that efficient, particularly at lower heat and pressures.

To overcome this, it is proposed that the unused energy is recycled or reused, with the goal being to convert the energy into electricity of an amount similar to the amount of energy absorbed at the heat source. In other words, each time the energy is recycled, more energy is presented to the turbine until the above goal is achieved, thereby countering the inefficiencies of most commercially available turbines.

A further proposal is to increase the efficiency of the system by using the temperature drop generated on the cold side of the heat pump to generate electricity using a different working fluid.

The increased efficiency comes from the fact that almost no added energy needs to be added to the system, for this extra generation of the electricity. This gives a second opportunity to extract energy from the heat source.

A further way of improving the efficiency of the system is by embedding the system in thermal insulation, because much of the energy can be lost through heat loss.

The theoretical principle of it is envisaged that the multi-cycle power generator will operate is set out below. The formulae to run a heat pump is as follows:

$$COP = \frac{Q}{W}$$

where

Q is the heat supplied to or removed from the reservoir; and

W is the work consumed by the heat pump.

The COP for heating and cooling are thus different. For cooling, the COP is the ratio between the heat removed from the cold reservoir to input work. For heating, the COP is the ratio between the heat removed from the cold reservoir plus the heat added to the hot reservoir to the input work:

$$COP_{heating} = \frac{|Q_H|}{W} = \frac{|Q_C| + W}{W}$$

$$COP_{cooling} = \frac{|Q_C|}{W}$$

where $Q_C$ is the heat removed from the cold reservoir; and $Q_H$ is the heat supplied to the hot reservoir.

According to the first law of thermodynamics, in a reversible system we can show that $Q_{hot}=Q_{cold}+W$ and $W=Q_{hot}-Q_{cold}$, where $Q_{hot}$ is the heat transferred to the hot reservoir and $Q_{cold}$ is the heat collected from the cold reservoir.

Therefore, by substituting for W:

$$COP_{heating} = \frac{Q_{hot}}{Q_{hot} - Q_{cold}}$$

For a heat pump operating at maximum theoretical efficiency (i.e. Carnot efficiency), it can be shown that:

$$\frac{Q_{hot}}{T_{hot}} = \frac{Q_{cold}}{T_{cold}} \text{ and } Q_{cold} = \frac{Q_{hot} T_{cold}}{T_{hot}}$$

where $T_{hot}$ and $T_{cold}$ are the temperatures of the hot and cold heat reservoirs respectively. Note that these equations must use an absolute temperature scale, for example, Kelvin or Rankine.

At maximum theoretical efficiency:

$$COP_{heating} = \frac{T_{hot}}{T_{hot} - T_{cold}}$$

which is equal to the reciprocal of the ideal efficiency for a heat engine, because a heat pump is a heat engine operating in reverse. Similarly:

$$COP_{cooling} = \frac{Q_{cold}}{Q_{hot} - Q_{cold}} = \frac{T_{cold}}{T_{hot} - T_{cold}}$$

The COP of the hot side is greater than the COP of the cold side. This is due to the fact that the heat rejected to the hot sink is equivalent to the amount of heat extracted from the cold source plus the heat generated from the heat pump engine, whereas the cold source looses heat without the benefit of the added energy of the heat pump. In other words, the cold source gets less cold than the heat sink gets hot.

$COP_{heating}$ applies to heat pumps and $COP_{cooling}$ applies to air conditioners or refrigerators. For heat engines, values for actual systems will always be less than these theoretical maximums.

As the formula shows, the COP of a heat pump system can be improved by reducing the temperature gap $T_{hot}$ minus $T_{cold}$ at which the system works. For a heating system this would mean two things:

1. reducing the output temperature to around 30° C. (86° F.), which would require piped floor, wall or ceiling heating, or alternatively, oversized water to air heaters; and
2. increasing the input temperature (e.g. by using an oversized ground source or by access to a solar-assisted thermal bank.

The heat pump itself can be improved by increasing the size of the internal heat exchangers relative to the power of the compressor, and to reduce the system's internal temperature gap over the compressor.

It is therefore an object of the present invention to provide a power generator comprising of a hot power cycle, a cool power cycle and a heat pump cycle, working on the principles set out above, which power generator may be a stand alone system or part of another system.

SUMMARY OF THE INVENTION

According to the invention there is provided a multi-cycle power generator including:

a heat pump cycle comprising at least a plurality of heat exchangers, a heat pump for pumping a first working fluid through the heat pump cycle and an expansion valve for throttling the first working fluid;

a hot power cycle comprising at least a pair of heat exchangers, a first pump for pumping a second working fluid through the hot power cycle and a first power generating device operatively driven by the second working fluid expanding therein; and wherein the pair of heat exchangers of the hot power cycle are common with two heat exchangers of the heat pump cycle.

In a particularly preferred embodiment of the invention, the multi-cycle power generator further includes:

a cool power cycle comprising at least a pair of heat exchangers, a second pump for pumping a third working fluid through the cool power cycle and a second power generating device operatively driven by the third working fluid expanding therein;

wherein one of the heat exchangers of the cool power cycle is common with one of the heat exchangers of the heat pump cycle.

The heat exchangers may be same-direction flow heat exchangers, which will be appreciated to mean that the heat transferring working fluids passing through the heat exchanger flow there through in the same or similar direction.

Alternatively, the heat exchangers may be reverse flow heat exchangers, which will be appreciated to mean that the heat transferring working fluids passing through the heat exchanger flow there through in opposite or substantially opposite directions.

The first of the common heat exchangers between the heat pump cycle and the hot power cycle generally acts as a primary condenser for condensing the second working fluid operatively passing there through, with the second of the common heat exchangers between the heat pump cycle and the hot power cycle generally acting as a primary evaporator for evaporating the second working fluid operatively passing there through.

The primary condenser, further to condensing the second working fluid operatively passing there through, may operatively heat the first working fluid passing there through as a result of heat transfer acting between the first and second working fluids, thereby to increase the temperature of the first working fluid presented to the heat pump.

In the hot power cycle, the primary evaporator may be upstream of the first power generating device, with the primary condenser typically upstream of the primary evaporator. Preferably, the first pump is intermediate the primary condenser and the primary evaporator.

Generally, the common heat exchanger between the heat pump cycle and the cool power cycle acts as a secondary condenser for condensing the third working fluid operatively passing there through. Furthermore, the second of the pair of heat exchangers of the cool power cycle may be a secondary evaporator for evaporating the third working fluid operatively passing there through.

In the cool power cycle, the secondary evaporator may be upstream of the second power generating device, with the secondary condenser typically upstream of the secondary evaporator. Preferably, the second pump is intermediate the secondary condenser and the secondary evaporator.

In a preferred embodiment, the plurality of heat exchangers of the heat pump cycle may be the primary condenser, the primary evaporator, the secondary condenser and a fourth heat exchanger.

In the heat pump cycle, the primary condenser may be upstream of the primary evaporator, with the primary evaporator generally upstream of the secondary condenser and the secondary condenser typically upstream of the fourth heat exchanger such that the fourth heat exchanger is intermediate the secondary condenser and the primary condenser.

Preferably, the expansion valve is intermediate the primary evaporator and the secondary condenser. More preferably, the heat pump is intermediate the primary condenser and the primary evaporator.

Generally, the third working fluid has a boiling point lower than the boiling point of the second working fluid.

The fourth heat exchanger and the secondary evaporator may be in the form of radiators. Furthermore, the radiators may comprise fans for blowing air there over.

The first and second power generating devices may be turbine-generator devices, heat engine devices, thermocouples and/or any other type of electricity generating device capable of converting kinetic energy into electrical energy.

BRIEF DESCRIPTION OF THE DRAWINGS

The invention will now be described in more detail, by way of example only, with reference to the accompanying drawings in which:

FIG. 1 is a schematic representation of the multi-cycle power generator in accordance with the present invention.

DETAILED DESCRIPTION OF THE DRAWINGS

A multi-cycle power generator according to a preferred embodiment of the invention is designated generally in the accompanying FIGURE with reference numeral 10. The multi-cycle power generator comprises a heat pump cycle 20, a hot power cycle 40 and a cool power cycle 60, with the arrows illustrating the direction of flow of the working fluids in each of the cycles.

It will be appreciated that although the preferred illustrated embodiment shows the combination of the three aforementioned cycles, the power generator is capable of functioning with the heat pump cycle 20 and the hot power cycle 40 only.

The heat pump cycle 20 comprises of a series of heat exchangers, being in the form of a primary condenser 22, a primary evaporator 24, a secondary condenser 26 and a radiator 28. As illustrated in FIG. 1, the heat exchangers are positioned in the heat pump cycle such that the primary condenser 22 is upstream of the primary evaporator 24, which is in turn upstream of the secondary condenser 26, which is in turn upstream of the radiator 28 such that the radiator 28 is intermediate the secondary condenser 26 and the primary condenser 22.

The heat pump cycle 20 further comprises a heat pump 30, for circulating a first working fluid through the heat pump cycle 20, and an expansion valve 32, positioned intermediate the primary evaporator 24 and the secondary condenser 26, for throttling the first working fluid operatively exiting the primary evaporator 32. In the preferred embodiment of the invention, the heat pump 30 is positioned intermediate the primary condenser 22 and the primary evaporator 24.

It will be appreciated from FIG. 1 that the primary condenser 22 and primary evaporator 24 are heat exchangers common to heat pump cycle 20 and the hot power cycle 40, with the hot power cycle 40 further comprising a first pump 42 for circulating a second working fluid through the hot power cycle 40, and a first turbine 44 operatively driven by the second working fluid expanding therein.

The first turbine 44 is coupled to a first generator 46 for converting kinetic energy of the turbine into electrical power. In the preferred illustrated embodiment, and with reference to the hot power cycle 40, the primary condenser 22 is upstream of the primary evaporator 24, which in turn is upstream the first turbine 44. Preferably, the first pump 42 is positioned in the hot power cycle 40 intermediate the primary condenser 22 and the primary evaporator 24.

It will be appreciated from FIG. 1 that the secondary condenser 26 is a heat exchanger common to the heat pump cycle 20 and the cool power cycle 60, with the cool power cycle 60 further comprising a second pump 62 for circulating a third working fluid through the cool power cycle 60, and a second turbine 64 operatively driven by the third working fluid expanding therein.

The second turbine 64 is coupled to a second generator 66 for converting kinetic energy of the turbine into electrical power. In the preferred illustrated embodiment, and with reference to the cool power cycle 60, the secondary condenser 22 is upstream of a secondary evaporator 68, which in turn is upstream of the second turbine 64. Preferably, the second pump 62 is positioned in the cool power cycle 60 intermediate the secondary condenser 26 and the secondary evaporator 68.

It will be appreciated that although the fourth heat exchanger 28 and the secondary evaporator 68 may take any form, they are preferably in the form of radiators. Furthermore, the radiators may have fans for blowing air over the radiators 28, 68, or a single fan for blowing air over both radiators 28, 68 to save energy.

For the power generator 10 to function, the third working fluid must have a boiling point lower than that of the second working fluid.

In use, heat energy is extracted from the surrounding (heat source) and absorbed into the first working fluid via radiator 28. The first working fluid, now at about the same temperature as the temperature of the surroundings from which the heat energy was extracted moves along the heat pump cycle, entering the primary condenser 22.

As the first working fluid passes through the primary condenser 22, heat is transferred from the second working fluid in the hot power cycle 40 into the first working fluid, thereby to further increase the temperature of the first working fluid, while decreasing the temperature of the second working fluid below its boiling point, causing the second working fluid to condense.

The now hotter first working fluid exists the primary condenser 22 and enters the heat pump 30. The heat pump 30 compresses the first working fluid thereby to increase the concentration of energy in the first working fluid, consequentially raising its temperature once more.

The first working fluid, now at its highest temperature, enters the primary evaporator 24 enabling heat transfer between the first working fluid and the second working fluid, thereby to evaporate the second working fluid in the hot power cycle 40. As the first working fluid exists the primary evaporator 24, it passes through an expansion valve 32, through which the first working fluid is throttled and rapidly cooled.

The cooled first working fluid then enters the secondary condenser 26, enabling excess heat to be extracted from the third working fluid into the first working fluid, thereby causing the third working fluid to condense.

Preferably, the third working fluid has a boiling point lower than the surrounding temperature (i.e. from which the energy was initially extracted), but higher than the cooled first working fluid exiting the expansion valve 32. The first working fluid then pass back through the radiator 28 where the whole cycle will repeat itself.

It will be appreciated that COP of the heat pump cycle 20 is the sum of energy inputs from the radiator 28, the primary condenser 22 and the heat pump 30, divided by the energy utilized by the heat pump cycle 20.

In the hot power cycle 40, and starting at the primary evaporator 24, the second working fluid now having been evaporated in the primary evaporator 24 has a total saturated energy $h_g$ defined by the following formula:

$$h_g = h_f + h_{fg}$$

where: $h_g$=total enthalpy of saturated steam (total heat—kJ/kg);

$h_f$=liquid enthalpy (sensible heat—kJ/kg); and $h_{fg}$=enthalpy of evaporation (latent heat—kJ/kg).

This formula illustrates that the two heat sources are concentrated in the primary evaporator 24, namely the energy in the condensed second working fluid. The recycling of the heat through the heat pump 30 is key to the operation of the invention due to the heat pump 30 increasing the concentration of energy therein, thereby increasing the energy concentration by the COP.

The second working fluid then enters and expands through the first turbine 44 (or other electrical power generating device), thereby converting heat energy into kinetic energy, driving a first generator 46 coupled to the first turbine 44 for the purposes of converting the kinetic energy of the first turbine into electrical power.

After having expanded through the first turbine 44, the second working fluid enters the primary condenser 22, where the second working fluid is cooled below its boiling point and condensed. The condensed second working fluid then passes into the first pump 42, pumping it into the primary evaporator 24, where the cycle will repeat itself.

In the cool power cycle 60, and starting at the secondary condenser 26, the third working fluid is cooled and condenser and pumped to the secondary evaporator 68, in the form of a radiator or other form of heat exchanger, by the second pump 62.

Surrounding heat is then absorbed into the third working fluid via the radiator 68, thereby to evaporate the third working fluid, which is in turn passed into the second turbine 64 (or other electrical power generating device), and allows to expand there through to convert heat energy in the third working fluid into kinetic energy. This kinetic energy is in turn converted into electrical power by the generator 66 being driven by the second turbine 64.

After having expanded through the second turbine 64, the third working fluid is returned to the secondary condenser 26 where the cycle repeats itself.

Although the heat exchangers in the accompanying FIGURE have been illustrated as same-direction flow heat exchangers, they may in fact be reverse flow heat exchangers. It is envisaged that reverse flow heat exchangers will have significant increase in the efficiency of the power generator 10 of the present invention.

It will be appreciated that the power generated by the first and second generators 46, 66 may be used to at least partially power the pumps of the multi-cycle power generator 10, thereby reducing the power required by the pumps and fans from an outside source.

Although the invention has been described above with reference to preferred embodiments, it will be appreciated that many modifications or variations of the invention are possible without departing from the spirit or scope of the invention. For example, instead of having turbines and generators as the power generating devices, other devices may be used.

For example, heat engines or thermocouples. Another example is that instead of having "direct" heat transfer within the heat exchangers of the type herein described and illustrated, heat transfer between the heat absorbing/sinking components may be accomplished using ducting and fan blowing air through the ducting.

The invention claimed is:

1. A multi-cycle power generator including:

a heat pump cycle comprising at least a plurality of heat exchangers, a heat pump for pumping a first working fluid through the heat pump cycle and an expansion valve for throttling the first working fluid;

a hot power cycle having a first pump for pumping a second working fluid through the hot power cycle, characterized in that the hot power cycle comprising at least a pair of heat exchangers through which the second working fluid flows, and a first power generating device operatively driven by the second working fluid expanding therein; and a cool power cycle comprising at least a pair of heat exchangers, a second pump for pumping a third working fluid through the cool power cycle and a second power generating device operatively driven by the third working fluid expanding therein;

further characterized in that:

(i) the pair of heat exchangers of the hot power cycle are common with two heat exchangers of the heat pump cycle;

(ii) one of the heat exchangers of the cool power cycle is common with one of the heat exchangers of the heat pump cycle;

(iii) the heat exchangers are same-direction flow heat exchangers or reverse flow heat exchangers; and (iv) the first of the common heat exchangers between the heat pump cycle and the hot power cycle acts as a primary condenser for condensing the second working fluid operatively passing there through, with the second of the common heat exchangers between the heat pump cycle and the hot power cycle acting as a primary evaporator for evaporating the second working fluid operatively passing there through.

2. A multi-cycle power generator according to claim 1, wherein the primary condenser, further to condensing the second working fluid operatively passing there through, operatively heats the first working fluid passing there through as a result of heat transfer acting between the first and second working fluids, thereby to increase the temperature of the first working fluid presented to the heat pump.

3. A multi-cycle power generator according to claim 2, wherein in the hot power cycle, the primary evaporator is upstream of the first power generating device, and further wherein the primary condenser is upstream of the primary evaporator.

4. A multi-cycle power generator according to claim 3, wherein the first pump is intermediate the primary condenser and the primary evaporator.

5. A multi-cycle power generator according to claim 4 wherein the common heat exchanger between the heat pump cycle and the cool power cycle acts as a secondary condenser for condensing the third working fluid operatively passing there through.

6. A multi-cycle power generator according to claim 5, wherein the second of the pair of heat exchangers of the cool power cycle is a secondary evaporator for evaporating the third working fluid operatively passing there through.

7. A multi-cycle power generator according to claim 6, wherein in the cool power cycle, the secondary evaporator is upstream of the second power generating device, and further wherein the secondary condenser is upstream of the secondary evaporator.

8. A multi-cycle power generator according to claim 7, wherein the second pump is intermediate the secondary condenser and the secondary evaporator.

9. A multi-cycle power generator according to claim 8, wherein the plurality of heat exchangers of the heat pump cycle are the primary condenser, the primary evaporator, the secondary condenser and a fourth heat exchanger.

10. A multi-cycle power generator according to claim 9, wherein in the heat pump cycle: the primary condenser is upstream of the primary evaporator; the primary evaporator is upstream of the secondary condenser; the secondary condenser is upstream of the fourth heat exchanger such that the fourth heat exchanger is intermediate the secondary condenser and the primary condenser.

11. A multi-cycle power generator according to claim 10, wherein the expansion valve is intermediate the primary evaporator and the secondary condenser.

12. A multi-cycle power generator according to claim 11, wherein the heat pump is intermediate the primary condenser and the primary evaporator.

13. A multi-cycle power generator according to claim 12, wherein the third working fluid has a boiling point lower than the boiling point of the second working fluid.

14. A multi-cycle power generator according to claim 13, wherein the fourth heat exchanger and the secondary evaporator are in the form of radiators.

15. A multi-cycle power generator according to claim 14, wherein the radiators comprise fans for blowing air there over.

16. A multi-cycle power generator according to claim 15, wherein the first and second power generating devices are a turbine-generator devices, heat engine devices, thermocouples and/or any other type of electricity generating device capable of converting kinetic energy into electrical energy.

* * * * *